US005746880A

United States Patent [19]

Umino

[11] Patent Number: 5,746,880

[45] Date of Patent: May 5, 1998

[54] TAPE CASSETTE AND AUTOMATIC ATTACHING APPARATUS FOR HEAT-FUSIBLE TAPE PIECES

[75] Inventor: Mitsugu Umino, Toyama-ken, Japan

[73] Assignee: Yoshida Kogyo K.K., Tokyo, Japan

[21] Appl. No.: 548,780

[22] Filed: Oct. 26, 1995

Related U.S. Application Data

[63] Continuation of Ser. No. 145,135, Nov. 3, 1993, abandoned.

[30] Foreign Application Priority Data

Nov. 6, 1992 [JP] Japan ..... 4-297005

[51] Int. Cl.[6] ..... B32B 31/00

[52] U.S. Cl. ..... 156/517; 156/519; 156/580.1; 156/303

[58] Field of Search ..... 156/302, 303, 156/354, 505, 506, 502, 304.1, 361, 580.1, 545, 353, 517, 519

[56] References Cited

U.S. PATENT DOCUMENTS 3,939,032 2/1976 Taitel et al. ..... 156/505
4,242,167 12/1980 Hoffmann ..... 156/361 X
4,462,854 7/1984 Wenstrom et al. ..... 156/303 X

FOREIGN PATENT DOCUMENTS 0 092 789 11/1983 European Pat. Off. .
0 221 737 5/1987 European Pat. Off. .
1753138 4/1971 Germany .
63-40085 8/1988 Japan .

*Primary Examiner*—James Engel
*Attorney, Agent, or Firm*—Hill & Simpson

[57] ABSTRACT

In an automatic heat-fusible tape pieces attaching apparatus, a plurality of tape cassettes, each including a reel support part rotatably supporting a tape reel and a tape guide part defining a tape guide path extending from the reel support part in a direction of drawing a thermoplactic tape, the tape guide part having pressure rollers sectioning a part of the tape guide path, and a window through which part of the pressure rollers is exposed to the outside from the tape guide part, are detachably supported at predetermined distances on a tape cassette support base situated alongside of a traveling path of the strip and movable along the traveling path for positioning. The support base is moved to position and hold a desired cassette in an extension line of the attaching portion, and the tape is cut off as the tape piece is left on the attaching portion, whereupon the tape is attached to the front surface of the strip by a thermoplastic tape piece fusing means.

9 Claims, 4 Drawing Sheets

TAPE CASSETTE AND AUTOMATIC ATTACHING APPARATUS FOR HEAT-FUSIBLE TAPE PIECES

This is a continuation of application Ser. No. 08/145,135, filed Nov. 3, 1993 now abandoned.

BACKGROUND OF THE INVENTION

1. Field of the Invention

This invention relates to a tape cassette for use in a machine for successively attaching reinforcing tape pieces closely to the respective space portions of slide fastener chain, a machine for automatically attaching markers, in the form of tape pieces, to a running strip at predetermined distances, a surface fastener manufacturing machine, a ribbon tape processing machine, etc., and also to an automatic heat-fusible tape piece attaching apparatus using the tape cassette. More particularly the invention relates to a tape cassette with which the tape can be changed in a simple manner to cope with flexible manufacturing and also to an automatic heat-fusible tape piece attaching apparatus using such tape cassette.

2. Description of the Related Art

This type of conventional automatic heat-fusible tape piece attaching apparatus is disclosed in, for example, Japanese Patent Publications Nos. SHO 62-23693, 63-34725 and 63-40085. In each of these conventional apparatuses, a thermoplastic tape holder is fixed; for instance, if the fastener tapes of a slide fastener chain are to be exchanged with those of different color, the reinforcing thermoplastic tapes also have to be exchanged with those of the same color as that of the fastener tapes.

As fashion of clothing, bags, sacks and other daily goods is changing drastically and into a great variety in recent years, slide fasteners to be used for these products require increasingly many colors and sizes and a very limited quantity of products for each kind.

However, in the automatic heat-fusible tape piece attaching apparatuses of the above-mentioned publications or any other conventional apparatuses of this type, a supply part for the thermoplastic tape is fixed so that exchange of tape cannot take place until the apparatus is stopped, thus causing a very low operating rate. To this end, in order to reduce the number of times of exchanging the tape, it has been a common practice to take lot organizing work at the moment.

SUMMARY OF THE INVENTION

It is therefore an object of this invention to provide a tape cassette which eliminates exchange work in lot and enables tape exchange at any time without stopping the apparatus, and also to an automatic heat-fusible tape piece attaching apparatus using such tape cassette.

In order to accomplish the above object, according to one aspect of the invention, there is provided a tape cassette equipped with a reel support part rotatably supporting a tape reel, and a tape guide part defining a tape guide path extending from the reel support part in a direction of drawing a tape, wherein the tape guide part has pressure rollers sectioning a part of the tape guide path, and a window through which part of the pressure rollers is exposed to the outside from the tape guide part.

As a typical embodiment, the reel support part is arranged on upper and lower sides of the tape guide path, the tape guide part having a square pillar, the tape guide path being divided into upper and lower steps within the tape guide part, the tape guide path being sectioned by the pressure rollers which are rotatably mounted at upstream and downstream positions, respectively, in the tape guide part. Further, the tape guide part further includes an operation lever inserted through the tape guide path, and a lock member operable, in response to the actuation of the operation lever, to project into and retract from the tape guide path for engagement with and disengagement from a tape cassette mount.

According to another aspect of the invention, there is provided an apparatus for automatically attaching heat-fusible tape pieces successively onto a surface of a continuous strip at predetermined distances while the strip is being intermittently conveyed, the apparatus comprising: a tape cassette equipped with a reel support part rotatably supporting a tape reel, and a tape guide part defining a tape guide path extending from the reel support part in a direction of drawing a tape; a tape cassette support base situated alongside of a traveling path of the strip and able to detachably support a plurality of the tape cassettes at predetermined distances along the traveling path, the tape cassette support base being movable along the traveling path for positioning; and a tape piece fusing means situated on the traveling path of the strip at a predetermined position within a range of movement of the tape cassette support base.

Specifically, the tape guide part has pressure rollers sectioning a part of the tape guide path, and a window through which part of the pressure rollers is exposed to the outside from the tape guide part, there being situated drive rollers movable to come into and out of engagement with the respective exposed surfaces of the pressure rollers. Further, gripping means is situated in an extension line passing through the tape cassette support base and the tape piece fusing means for gripping a tape end of the tape cassette. And cutting means is situated between the tape cassette support base and the tape piece fusing means for cutting a predetermined length of tape piece off a thermoplastic tape drawn from the tape cassette.

For mounting the tape cassette of this invention on the tape cassette mount, the tape cassette is inserted into a cassette receiving groove of the tape cassette mount and, at the same time, the leading end of the tape cassette is brought into engagement with part of the tape cassette mount. At that time, the lock member is projected outwardly from the tape guide path of the tape guide part to engage part of the tape cassette mount. Thus the tape cassette can be mounted in a single snap action.

For removing the tape cassette from the tape cassette mount, when the operation lever is pulled toward the operator, then the lock member resiliently resting on the cam surface of the front end of the lever is raised against the resilience to retract its engaging portion into the tape guide path of the tape guide part, releasing the locking engagement with the tape support base.

If the tape cassette having such function is used in the automatic thermoplastic tape attaching apparatus of the invention, a plurality of tape cassette prepared on the tape cassette support base according to predetermined production planning are mounted on the respective tape cassette mounts. This mounting procedure is as described above.

Then, the support base drive is activated by an instruction from a control means to move the tape cassette so that the tape cassette containing a thermoplastic tape to be attached will be positioned in the traveling path of tape in the attaching position. At that time, the positioning means is activated to lock the tape cassette support base in the position. Now, as the upper and lower feed rollers come into contact with the reinforcing thermoplastic tape being guided on the exposed surfaces of the front and back pressure rollers of the tape cassette and start driven rotation to feed the thermoplastic tape forwardly by a predetermined length.

At this time point, the continuous strip traveling across in front of the tape cassette support base is stopping with the tape piece attaching portion reached in front of the tape cassette. At that time, the leading end portion of the thermoplastic tape is guided by the tape guide member so that its end is gripped by the gripper situated in front of the tape cassette support base. Subsequently, the gripper with the leading end of the thermoplastic tape gripped thereby is moved by a predetermined distance to bring the thermoplastic tape into contact with each of front and back surfaces of the tape piece attaching portion of the strip, whereupon the cutter is activated to cut transversely the leading end portion of the tape.

Then, the tape piece fusing means is moved toward the tape to bring the leading end portion of the thermoplastic tape against the attaching portion of the strip and fuses them together, and cut the thermoplastic tape by a length corresponding to the width of the strip. Upon termination of cutting of the thermoplastic tape, the gripper releases the leading end portion of the thermoplastic tape. Simultaneously with the cutting, the feed rollers make only a predetermined number of reverse rotations to bring the cut end of the thermoplastic tape back to the throat or front end portion of the tape guide part, whereupon the feed rollers are moved apart from the tape cassette.

Upon completion of the first attaching process for a desired length of strip as the foregoing operation for the same tape cassette is repeated a predetermined number of times, the support base drive and the positioning means are activated again by an instruction from the control means to move the tape cassette support base and, at the same time, to move the tape cassette containing the thermoplastic tape to be attached for the next, to the attaching portion in the traveling path of tape, thereby fixedly holding the tape cassette there. Then, the attaching process for the tape pieces to a predetermined length of the second strip takes place automatically as the foregoing operation is repeated.

When the tape reel of part of the tape cassettes is emptied as the attaching process progresses, only the tape cassette is removed from the tape cassette support base for exchange with a new one. This cassette exchange can be performed by a simple operation, i.e., by only pulling the actuation lever of the tape cassette toward the operator.

DETAILED DESCRIPTION

Figure 1:
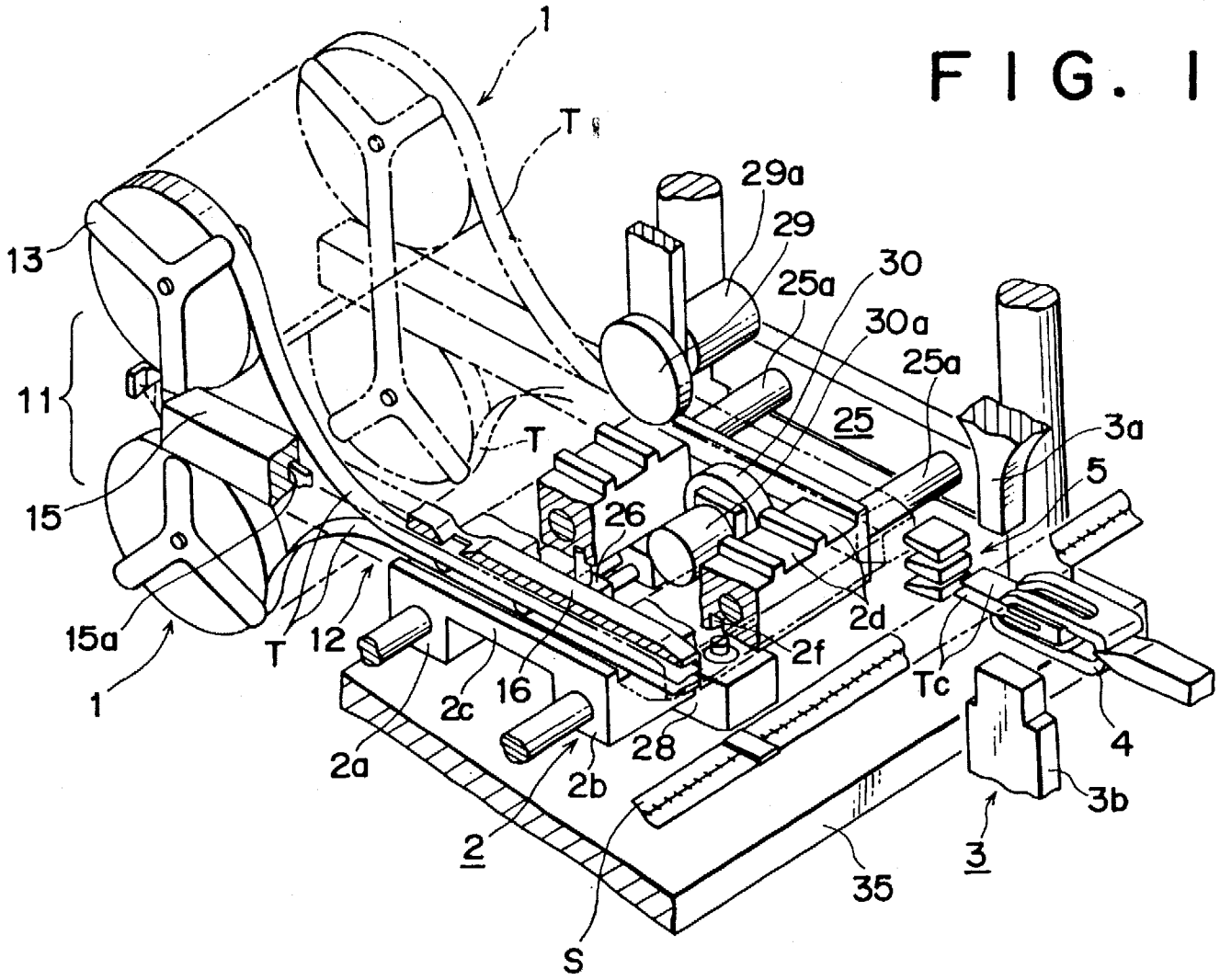
FIG. 1 is a fragmentary perspective view, with parts broken away, of an apparatus, for automatically attaching reinforcing tape pieces to a slide fastener chain, according to a typical embodiment of this invention.
Figure 2:
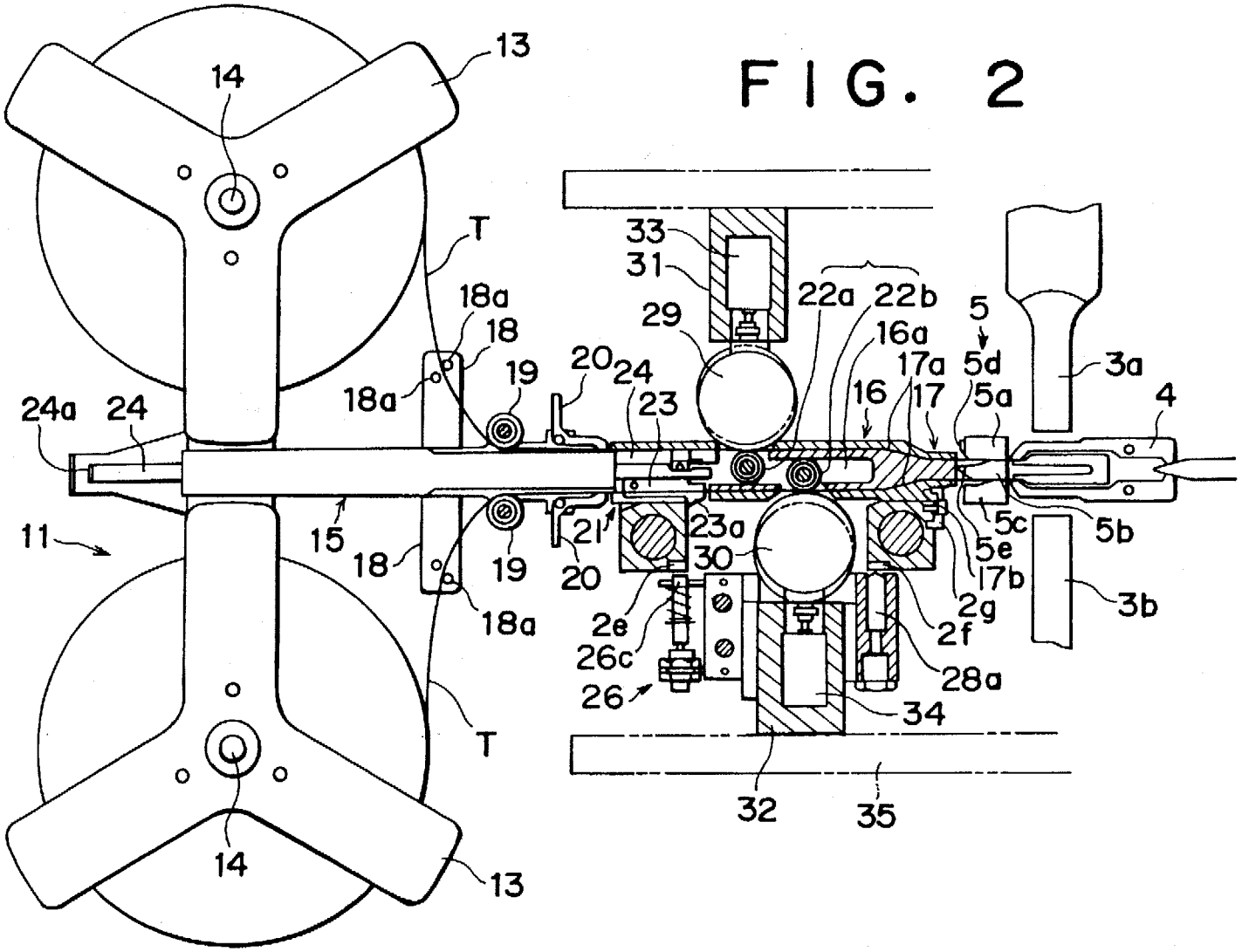
FIG. 2 is an enlarged side view, partially in cross section, of the main components of the apparatus.

An embodiment of this invention will now be described with reference to the accompanying drawings. FIG. 1 is a perspective view, with parts broken away, of the main part of an automatic heat-fusible tape piece attaching apparatus applied to a slide fastener chain manufacturing machine according to a typical embodiment of the invention. FIG. 2 is an enlarged cross-sectional view of FIG. 1. The remaining components other than those shown in these views are described in detail in the above-mentioned publications, so their detailed description is omitted here for clarity.

As shown in FIG. 1, the main components of this invention is a thermoplastic tape supply part. The tape supply part includes a tape cassette 1 with a reel support part 11 and a tape guide part 12, a tape cassette support base 2 for supporting a plurality of tape cassettes 1 in row and for moving a desired tape cassette 1 to position it in alignment with a thermoplastic tape attaching portion, and a tape piece fusing means 3 to be located in the travelling path of a slide fastener chain at a predetermined position within a range of movement of the tape cassette support base 2.

In order that the reinforcing tape pieces Tc are attached to front and back surfaces of the slide fastener chain S at a position near the space portion, the tape cassette 1 of the illustrated embodiment has a generally T-shape contour. A reel support part 11 has a bracket (not shown) supporting a set of upper and lower reels 13, and a tape guide part 12 horizontally extending forwardly (rightwardly in FIG. 2) from the center of the bracket.

The non-illustrated bracket of the reel support part 11 has a pair of cantilevered shafts 14 on which the upper and lower tape reels 13 are detachably and rotatably mounted and which is equipped with a known removing and mounting mechanism. The tape guide part 12 is in the form of a square pillar; the back half portion 15 (leftside in FIG. 2) has a through hole 15*a* of rectangular cross section extending centrally and longitudinally, while the front half portion 16 (rightside in FIG. 2) is in the form of a generally square tube having a hollow 16*a* of rectangular cross section. The tape guide part 12 has a front end portion constituting a throat 17 having upper and lower tape passageways 17*a*.

The tape guide part 12 has upper and lower guide levers 18 projecting substantially centrally from the back half portion 15 in opposite directions, each guide lever 18 having a pair of guide pins 18*a*. On the front side (rightside in FIG. 2) of the back half portion 15, upper and lower guide rollers 19 and upper and lower tape return preventing members 20 are situated in order along the traveling path of tape. Each tape return preventing member 20 is of an L shape as shown in FIG. 2 and has a claw, at a front end in the direction of travel of the thermoplastic tape T, confronting the tape surface; the tape return preventing member 20 is vertically pivotable about the center of the L shape. In the back half portion of the tape guide part 12, two heat-fusible tapes T drawn from the tape cassette 1 are guided each between the guide pin pair 18*a* and pass respectively between the upper guide roller 19 and the upper surface of the back half portion 15 and between the lower guide roller 19 and the lower surface of the back half portion 15. Downstream of the guide rollers 19, the tape return preventing members 20 in their tape return preventing position press the two tapes T against the upper and lower surfaces, respectively, of the back half portion 15. When the tape return preventing members 20 are released out of the tape return preventing position, the tapes T can be freely moved between the upper tape return preventing member 20 and the upper surface of the back half portion 15 and between the lower tape return preventing member 20 and the lower surface of the back half portion 15.

In the space 16*a* of rectangular cross section in the front half portion 16 except the throat 17 of the front end portion of the tape guide part 12, a support base holding and releasing mechanism 21, and a pair of pressure rollers 22*a*, 22*b* are situated in order from the back side to the front side. Two walls are situated over the back and front pressure rollers 22*a*, 22*b*, respectively, and each wall has a cutout through which part of the respective pressure roller 22*a*, 22*b* is exposed to outside. The pressure rollers 22*a*, 22*b* are rotatably mounted on the respective horizontal shafts in the space 16*a*.

Figure 3:
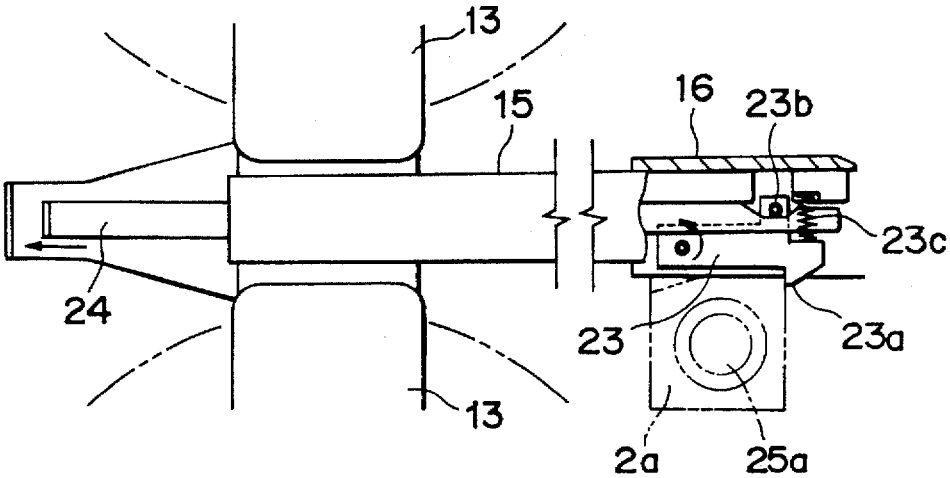
FIG. 3 is a schematic view, with parts broken away, of a tape cassette mounting and removing mechanism, illustrating the mounting function.
Figure 4:
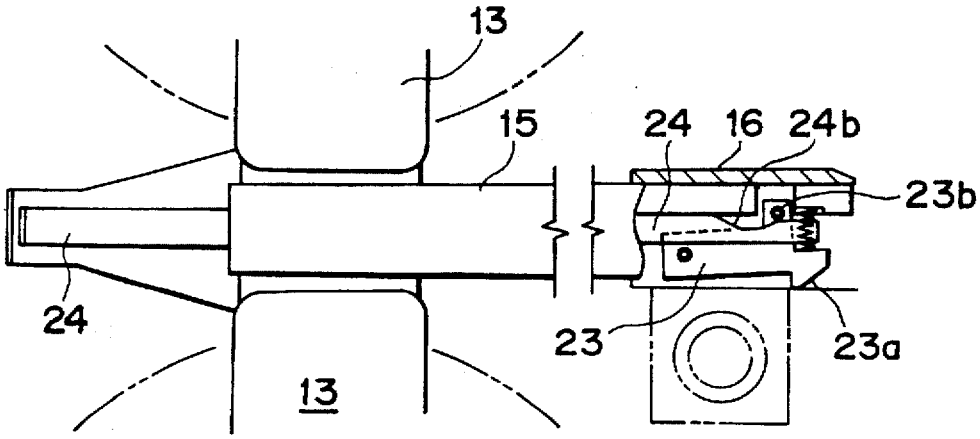
FIG. 4 is a schematic view of the mounting and removing mechanism, illustrating the removing function.

FIGS. 3 and 4 show the support base holding and releasing mechanism 21 in operative position. The support base holding and releasing mechanism 21, as shown in FIGS. 3 and 4, has at a lower portion of the front end a locking claw 23*a* engageable with part of the tape cassette support base 2 and at an upper portion of the front end a lock member 23 having a cam contact 23*b*. The back end portion of the lock member 23 is pivotally supported in the space 16*a* so that its front end is pivotally movable vertically. For this purpose, the lower wall of the front half portion 16 has an opening at a position under the lock member 23. A compression spring 23*c* is mounted between the front end of the lock member 23 and the upper wall of the front half portion 16 to urge the front end of the lock member 23 to pivotally move normally downwardly.

Further, the support base holding and releasing mechanism 21 has an operation lever 24 for the lock member 23. The operation lever 24 has at its back end a right-angled operating end portion 24*a* as shown in FIGS. 2 to 4 and on the upper surface of its front end a cam surface 24*b* on which the cam contact 23 of the lock member 23 resiliently rests. The operation lever 24, with its front end directed forwardly, is inserted into the through hole 15*a* extending centrally through the back half portion 15 and is positioned in such a manner that the cam contact 23*b* resiliently rests on the cam surface 24*b*. With this arrangement, as the operation lever 24 is moved forwardly and backwardly, the cam contact 23*b* moves upwardly and downwardly within the space 16 so that the locking claw 23*a* of the lock member 23 is projected from and retracted into the lower surface of the front half portion 16.

The throat 17 or the front end solid portion of the tape guide part 12 has upper and lower tape passageways 17*a* which open to the front end of the throat 17. The throat 17 has in the front portion of its lower surface an engaging groove 17*b* in which a below-described tape cassette locking member 2*g* of the tape cassette support base 2 engages.

The tape cassette 1 of the above-mentioned construction can be applied not only to the apparatus for attaching the reinforcing tape pieces Tc to the space portions of a slide fastener chain S like the illustrated example, but also to an apparatus for attaching markers in the form of tape pieces to woven fabrics for usual inventory purposes. It also may be used in, for example, production of a fastener tape or a supply means for a tape-like article such as a surface fastener or a ribbon tape.

The tape cassette support base 2, which is one of the components of this invention, will now be described in detail in connection with the illustrated example. The cassette support base 2 is in the form of a rectangular frame composed of two column blocks 2*a*, 2*b* connected by two connecting members 2*c* with a predetermined distance. The cassette support base 2 is situated and movable reciprocatingly alongside the traveling path of the slide fastener chain S as it is being positioned in a predetermined position parallel to the chain S. For this purpose, the tape cassette support base 2 is slidably supported on two guide rails 25*a* supported by a frame 25 and is restrictedly moved along the guide rails 25*a* by a below-described drive means to thereby be positioned in a predetermined position. On the upper surface of the tape cassette support base 2, there are formed a plurality of gutter-shape tape cassette mounts 2*d* for receiving a plurality of tape cassette 1 at predetermined distances, the tape cassette 1 being arranged perpendicularly to the traveling path of the slide fastener chain S.

According to the illustrated example, in the lower surface of the back block 2*a* of the tape cassette support base 2, there are formed a plurality of locking holes 2*e*, in which a drive pin 26*c* of a below-described support base drive 26 is engageable, at a predetermined pitch in the longitudinal direction, the number of the locking holes 2*e* being equal to that of the tape cassettes. Further, in the lower surface of the front block 2*b*, there are formed a plurality of engaging holes 2*f*, in which a positioning pin 28*a* of a below-described positioning means 28 is engageable, at the same pitch as the locking holes 2*e*, the number of the engaging holes 2*f* being equal to that of the locking holes 2*e*. To the front edge of each tape cassette mount 2*d* of the front block 2*b*, a generally C-shape tape cassette locking member 2*g* is fastened by a screw with its one arm projecting upwardly.

For mounting the tape cassette 1 on the tape cassette support base 2, the tape cassette 1 is fitted in the generally C-shape tape cassette mount 2*d* of the tape cassette support base 2 and, at the same time, the tape cassette locking member 2*g* attached to the front edge of the front block 2*b* is brought into locking engagement with the locking groove 17*b* formed in the front end of the throat 17 of the tape cassette 1. At that time, the locking claw 23*a* of the locking member 23 is projected downwardly from the space 16*a* of the tape guide part 12 under the resilience of the compression spring 23*c* to engage the upper edge of the back block 2*a*. Therefore, the mounting of the tape cassette 1 can be performed in a simple snap action.

For removing the tape cassette 1 from the tape cassette support base 2, when the operating end portion 24*a* of the operation lever 24 is gripped to pull the lever 24 toward the operator, then the cam contact 23*b* of the lock member 23 resiliently resting on the cam surface 24*b* of the front end portion of the lever 24 is raised against the resilience as shown in FIG. 4 to retract the locking claw 23*a* of the lock member 23 into the space 16*a* of the tape guide part 12, thus releasing the engagement with the tape support base 2 so that the tape cassette 1 can be removed simply.

In FIG. 2, the tape cassette 1 is mounted on the tape cassette support base 2, and upper and lower feed rollers 29, 30 are situated right above the back pressure roller 22*a* and right under the front pressure roller 22*b*, respectively, of the tape cassette 1 in the traveling paths of the thermoplastic tapes T. The feed rollers 29, 30 are operatively connected with drive motors 29*a*, 30*a* for driven rotation in synchronism. The upper and lower feed rollers 29, 30 together with the drive motors 29*a*, 30*a* are supported respectively by cylinders 33, 34 mounted on upper and lower frames 31, 32. As the cylinders 33, 34 are activated, the feed rollers 29, 30 are brought into contact with the respective exposed surfaces of the back and front pressure rollers 22*a*, 22*b* to rotate the pressure rollers 22*a*, 22*b* when feeding the tapes. When stopping the tapes, the feed rollers 29, 30 are moved apart from the exposed surfaces of the pressure rollers 22*a*, 22*b* and are stopped rotating.

Figure 5:
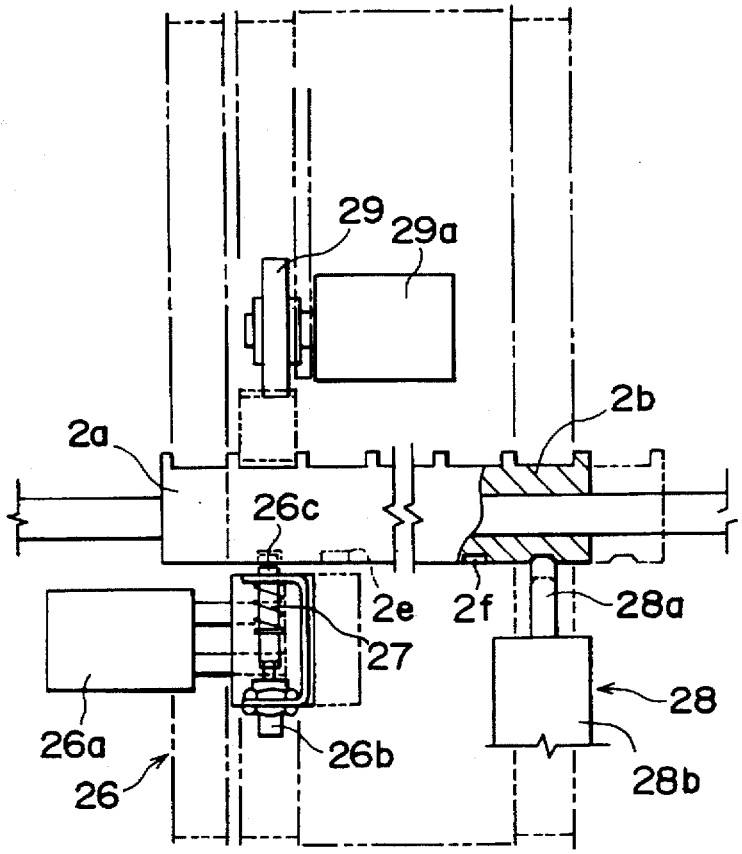
FIG. 5 is a front view, with parts broken away, of a support base drive and a support base positioning means, as an example, of this invention.

Under the back block 2*a* of the tape cassette support base 2, a support base drive 26 is fixedly mounted on the upper surface of the base 35 via a suitable support means. The support base drive 26 includes a support base drive cylinder 26*a* and a drive pin actuating cylinder 26*b* as shown in FIGS. 1, 2 and 5. The drive pin actuating cylinder 26*b* is vertically attached to the end of the rod of the horizontally extending support base drive cylinder 26*a*. The drive pin actuating cylinder 26*b* is an upwardly stretchable one-way actuating cylinder, and a drive pin 26*c* vertically attached to the rod end is normally urged downwardly by a compression spring 27 to shrink the drive pin actuating cylinder 26*b*.

The driving of the tape cassette support base 2 by the support base drive 26 will now be described. As air is drawn from the drive pin actuating cylinder 26*b* when driving the tape cassette support base 2, the drive pin 26*c* is disengaged from the locking hole 2*e* formed in the lower surface of the back block 2*a* indicated by phantom lines in FIG. 5, and then oil pressure sure in the rod stretching direction is charged into the support base drive cylinder 26*a* to move the drive pin 26*c* to a position right under the next locking hole 2*e* shown by phantom lines in FIG. 5. Then air is charged into the drive pin actuating cylinder 26*b* to stretch the drive pin 26*c* against the resilience of the compression spring 27 until the drive pin 26*c* comes into engagement with the locking hole 2*e* right above it. After that, oil pressure in the rod shrinking direction is charged into the support base drive cylinder 26*a* to return the drive pin 26*c* to the solid-line position so that the back block 2*a*, namely, the tape cassette support base 2 is moved leftwardly in the drawing to the solid-line position. If reverse operation is performed, the tape cassette support base 2 is moved rightwardly in the drawing by one pitch of the locking hole 2*e*.

As the result of the foregoing operations, the tape cassette support base 2 is moved reciprocatingly pitch by pitch of the locking hole 2*e* so that a desired tape cassette 1 on the tape cassette support base 2 is moved to a predetermined position, where the tape piece attaching portion is located, in the traveling path of tape.

According to the automatic reinforcing tape piece attaching apparatus of the illustrated embodiment, upon every termination of movement of the tape cassette support base 2 by the support base drive 26, the positioning means 28 is actuated to define the support base position and to fix the support base 2 in that position. The positioning means 28 is fixedly mounted on the upper surface of the base 35 via a suitable support means in confronting relationship with the engaging hole 2*f* of the front block 2*b*. The positioning means 28 is in the form of a cylinder 28*b* having a retractable locking pin 28*a* as shown in FIGS. 2 and 5. Each time the tape cassette support base 2 is moved by one pitch by the support base drive 26, the locking pin 28*a* is repeatedly projected from and retracted into the cylinder 28*b*, and finally the locking pin 28*a* comes into locking engagement with the corresponding engaging hole 2*f* of the front block 2*b* that has stopped moving, thereby locking the tape cassette support base 2 in that position. In the illustrated example, the locking pin 28*a* of the positioning means 28 is retractably projected by the actuation of the cylinder 28*b*. The inner surface of the engaging hole 2*f* may be inclined, and the locking pin 28*a* may be normally urged upwardly by, for example, a compression spring; in this case, the engaging and disengaging of the locking pin 28*a* with respect to the engaging hole 2*f* can be performed easily.

The foregoing description concerns to the tape cassette according to one embodiment of this invention and to the main components of the automatic thermoplastic tape piece attaching apparatus of the invention using that tape cassette. The automatic thermoplastic tape piece attaching apparatus includes, in addition to the above-mentioned components, a tape piece fusing means 3, a cutter 5 and a gripper 4. But the tape piece fusing means 3, the cutter 5 and the gripper 4 are not peculiar to this invention and are known in the prior art; as their details are disclosed in the above-mentioned publications, only a simple description of these additional components is made here for clarity.

In this embodiment, the tape piece fusing means 3 includes an ultrasonic horn 3*a* and an anvil 3*b* and is situated at the crossing of the traveling path of tape passing through the front and back feed rollers 29, 30 and the traveling path of a slide fastener chain S to which the tape pieces Tc are to be attached. According to the illustrated example, the cutter 5 has cutting blades 5*d*, 5*e* vertically slidable on the back surface (leftside in FIG. 2) of the tape guide members 5*a* to 5*c* in the form of upper, central and lower blocks. The gripper 4 is situated between the ultrasonic horn 3*a* and the anvil 3*b* and is actuated, during the tape attaching, to hold a predetermined length of the tape pieces Tc, which have been cut off from the thermoplastic tape T, in a fixed position of front and back surfaces of the slide fastener chain S. The gripper 4 is held in inoperative position at all times except during the tape attaching.

The attaching of the reinforcing tape pieces Tc to a slide fastener chain S using the reinforcing tape piece attaching apparatus will now be described. A plurality of tape cassette 1 prepared on the tape cassette support base 2 according to predetermined production planning are mounted on the respective tape cassette mounts 2*d*. This mounting procedure is already described above.

Then, the support base drive 26 is actuated, according to the above-mentioned operation by an instruction from a non-illustrated control means, to move the tape cassette support base 2 so that the tape cassette 1 containing the thermoplastic tapes T to be attached for the first is positioned at the attaching portion in the traveling paths of the tapes. At that time, the locking pin 28*a* of the positioning means 28 comes into locking engagement with the corresponding engaging hole 2*f* formed in the front block 2*b*, thus holding the tape cassette support base 2 in that position. The upper and lower feed rollers 29, 30 come into contact with the reinforcing thermoplastic tapes T being guided on the respective exposed surfaces of the pressure rollers 22*a*, 22*b* of the tape cassette 1 and starts driven rotation to feed the thermoplastic tapes T forwardly by a predetermined length.

At this time point, the slide fastener chain S traveling across in front of the tape cassette support base 2 is stopping with the reinforcing tape piece attaching portion reached in front of the tape cassette 1. At that time, the leading end portion of the thermoplastic tape T is guided by the tape guide members 5*a* to 5*c* so that its end is gripped by the gripper 4 situated in front of the tape cassette support base. Subsequently, the gripper 4 is moved rightwardly in FIG. 2 to bring the leading end portions of the reinforcing thermoplastic tapes T into contact with each of front and back surfaces of the tape piece attaching portion of the slide fastener chain S.

Then, the cutter 5 is actuated to cut the leading end portion transversely off the tape T. And the ultrasonic horn 3*a* and the anvil 3*b* of the tape piece fusing means 3 are moved toward each other to bring the leading end portion of the thermoplastic tape T against the attaching portion near the space of the slide fastener chain S, whereupon the thermoplastic tape and the slide fastener chain are fused together by ultrasonic process. Generally in this case, the tape attaching of the tape piece fusing means 3 is performed only about the core cords of the slide fastener chain S and, at the same time, the core cords of the tape attaching portion are fused and separated. And the cut-off piece of the thermoplastic tape is cut by a length corresponding to the width of the slide fastener chain S.

Upon termination of attaching the thermoplastic tape T, the gripper 4 releases the cut piece Tc of the thermoplastic tape T. Simultaneously with this cutting, the feed rollers 29, 30 make a predetermined number of reverse rotations to bring the cut end of the thermoplastic tape T back to the front end position of the throat 17 of the tape guide part 12, whereupon the feed rollers 29, 30 are moved apart from the tape cassette 1.

At that time, the slide fastener chain S is moved to a non-illustrated heating and fusing means, by which the unattached region of the thermoplastic tape to be attached is fused to the front and back surfaces of the slide fastener chain S. Upon completion of the first attaching process for a desired length of slide fastener chain S as the foregoing operation for the same tape cassette is repeated a predetermined number of times, the support base drive 26 and the positioning means 28 are activated again by an instruction from the control means to move the tape cassette support base 2 and, at the same time, to move the tape cassette 1 containing the thermoplastic tape T to be attached for the next, to the attaching portion in the traveling path of tape, thereby fixedly holding the tape cassette 1 there. Then, the attaching process for the tape pieces Tc to a predetermined length of the second slide fastener chain S takes place automatically as the foregoing operation is repeated.

When the tape reel 13 of part of the tape cassettes 1 is emptied as the attaching process progresses, only the tape cassette 1 is removed from the tape cassette support base 2 for exchange with a new one. This cassette exchange can be performed by a simple operation, i.e., by only pulling the operation lever 24 of the tape cassette 1 toward the operator.

The tape cassette of this invention can be applied to the apparatus for automatically attaching reinforcing tape pieces to a slide fastener chain like the foregoing embodiment as well as to many other applications. For example, it may be used in an apparatus for attaching marks to cloths for inventory, a surface fastener manufacturing machine as well as a supply part of a ribbon tape processing machine, etc.

As is apparent from the foregoing description, if the tape cassette of this invention is used in the supply part for a tape-like article, the tape together with the cassette can be exchanged with a new one in a simple operation. Since the tape exchange can be performed easily, it is possible not only to improve the rate of production but also to cope with recent flexible manufacturing.

Further, especially when the tape cassette of this invention is applied to the automatic attaching machine for the thermoplastic tape, the conventional lot organizing work will be completely unnecessary, and also there will be no need of stopping the apparatus, thus it will be possible to meet the customers' demands sufficiently and speedily.

What is claimed is:

1. An apparatus for automatically attaching heat-fusible tape pieces successively onto a surface of a continuous strip at predetermined distances while the strip is being intermittently conveyed, said apparatus comprising:

(a) a tape cassette equipped with a reel support part rotatably supporting a tape reel, and a tape guide part defining a tape guide path extending from said reel support part perpendicularly towards said continuous strip, said tape guide part further comprising a front half comprising a substantially enclosed tube through which the tape guide path passes, the tube accommodating a pressure roller sectioning a part of said tape guide path, and a window through which part of said pressure roller is exposed to the outside through said window, there being situated a drive roller movable to come into and out of engagement with the respective exposed surface of said pressure roller;

(b) a tape cassette support base situated alongside of a traveling path of the strip and able to detachably support a plurality of said tape cassettes spaced apart at predetermined distances along the traveling path, said tape cassette support base being movable along the traveling path for positioning; and (c) a tape piece fusing means situated on the traveling path of the strip at a predetermined position within a range of movement of said tape cassette support base.

2. An automatic heat-fusible tape piece attaching apparatus according to claim 1, wherein gripping means is situated in an extension line passing through said tape cassette support base and said tape piece fusing means for gripping a tape end of said tape cassette.

3. An automatic heat-fusible tape piece attaching apparatus according to claim 1, wherein cutting means is situated between said tape cassette support base and said tape piece fusing means for cutting a predetermined length of tape piece off a thermoplastic tape drawn from said tape cassette.

4. An automatic heat-fusible tape piece attaching apparatus according to claim 1, wherein said strip is a slide fastener chain having space portions intermittently.

5. An apparatus for automatically attaching heat-fusible tape pieces successively onto a surface of a continuous strip at predetermined distances while the strip is being intermittently conveyed, said apparatus comprising:

a plurality of tape cassettes each equipped with a reel support part rotatably supporting a tape reel, each tape reel holding a rolled supply of heat-fusible tape, and a tape guide part defining a tape guide path extending from said reel support part in a direction of drawing said tape from said reel perpendicular to said strip;

a tape cassette support base situated alongside of a traveling path of the strip and able to detachably support said plurality of tape cassettes spaced apart in pairs of cassettes at predetermined distances along the traveling path, each pair of cassettes arranged with said reels in vertical alignment with respective tapes of said cassette pairs in overlying relationship, said tape cassette support base being incrementally movable along the traveling path for positioning a select pair of said tape cassettes at a first position along the strip; and a tape piece fusing means situated on the traveling path of the strip at a predetermined position corresponding to said first position of said select pair of tape cassettes, said fusing means for fusing a portion of said respective tapes onto opposite sides of said strip.

6. An automatic heat-fusible tape piece attaching apparatus according to claim 5, wherein said tape guide part comprises a front half comprising a substantially enclosed tube, the tube accommodating at least two pressure rollers sectioning a part of said tape guide path, and at least two windows, each of said pressure rollers are exposed to the outside from said tape guide part through one of said windows, and at least two drive rollers, each drive roller movable to come into and out of engagement with an exposed surface of one of said pressure rollers.

7. An automatic heat-fusible tape piece attaching apparatus according to claim 5, further comprising gripping means situated in an extension line passing through said tape cassette support base and tape piece fusing means, for gripping tape ends of said respective tapes.

8. An automatic heat-fusible tape piece attaching apparatus according to claim 5, further comprising cutting means situated between said tape cassette support base and said tape piece fusing means for cutting a predetermined length of said respective tapes from said select pair of cassettes.

9. An automatic heat-fusible tape piece attaching apparatus according to claim 5, wherein said strip comprises a slide fastener chain and said tape pieces comprise reinforcing pieces for said slide fastener chain.

* * * * *